US010748522B2

(12) United States Patent
Yang

(10) Patent No.: US 10,748,522 B2
(45) Date of Patent: Aug. 18, 2020

(54) IN-EAR MICROPHONE WITH ACTIVE NOISE CONTROL

(71) Applicant: Bill Yang, Taipei (TW)

(72) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 0 days.

(21) Appl. No.: 16/571,170

(22) Filed: Sep. 15, 2019

(65) Prior Publication Data

US 2020/0090636 A1 Mar. 19, 2020

(30) Foreign Application Priority Data

Sep. 18, 2018 (TW) ..... 107132813 A

(51) Int. Cl.
*G10K 11/178* (2006.01)

(52) U.S. Cl.
CPC .. *G10K 11/17854* (2018.01); *G10K 11/17823* (2018.01); *G10K 11/17825* (2018.01); *G10K 11/17881* (2018.01); *G10K 2210/1081* (2013.01); *G10K 2210/3026* (2013.01); *G10K 2210/3027* (2013.01); *G10K 2210/3028* (2013.01)

(58) Field of Classification Search
CPC ..... G10K 11/17854; G10K 11/17823; G10K 11/17825; G10K 11/17881; G10K 2210/1081; G10K 2210/3027; G10K 2210/3026; G10K 2210/3028
See application file for complete search history.

(56) References Cited

U.S. PATENT DOCUMENTS

2014/0169579 A1* 6/2014 Azmi ..... G10K 11/16 381/71.6
2018/0020281 A1* 1/2018 Wurtz ..... G10K 11/178

FOREIGN PATENT DOCUMENTS

| | | |
|---|---|---|
| CN | 205249435 | 5/2016 |
| CN | 206024053 | 3/2017 |
| TW | 201707469 | 2/2017 |

OTHER PUBLICATIONS

English machine translation of CN206024053, 2017,7 pages (Year: 2017).*
English machine translation of CN205249435, 2016, 7 pages (Year: 2016).*
English machine translation of TWI605721, 2017, 8 pages (Year: 2017).*
"Office Action of Taiwan Counterpart Application," issued on Aug. 29, 2019, p. 1-p. 5.

* cited by examiner

*Primary Examiner* — Ping Lee
(74) *Attorney, Agent, or Firm* — JCIPRNET

(57) ABSTRACT

An in-ear microphone with active noise control is provided, including a housing, a speaker unit and a microphone module. The housing includes an air hole and a sound outlet. The speaker unit is disposed in the housing, and separates a space in the housing into a front chamber and a rear chamber. The microphone module is at least partially located in the front chamber and between the sound outlet and the speaker unit. The air hole is in communication with the sound outlet through the front chamber. The microphone module is configured to receive sound of a user and ambient sound.

13 Claims, 3 Drawing Sheets

IN-EAR MICROPHONE WITH ACTIVE NOISE CONTROL

CROSS-REFERENCE TO RELATED APPLICATION

This application claims the priority benefit of Taiwan application serial no. 107132813, filed on Sep. 18, 2018. The entirety of the above-mentioned patent application is hereby incorporated by reference herein and made a part of this specification.

BACKGROUND OF THE INVENTION

1. Field of the Invention

The present invention generally relates to an in-ear microphone, and in particular, to an in-ear microphone with active noise control.

2. Description of Related Art

With a continuous progress of science and technology, personal electronic products are all developed towards a trend of a light weight and miniaturization, smartphones, tablet computers, notebook computers and the like have become indispensable to people's daily life. For any electronic product mentioned above, an earphone has become a necessary element of the electronic product to enable a user to listen to sound information provided by the electronic product without disturbing others. Earphones can provide better sound transmission for listeners, enable the listeners to hear and understand sound contents clearly, without causing an ambiguity as transmission of sound in the air, and especially are not affected during a movement of the user, for example, in sports, driving, intense activities or noisy environments. In addition, to make calls by using the electronic products, earphone microphones with microphones are also common accessories.

To combine two functions of listening to sound and collecting sound, a traditional headset uses a design of separating an earphone from a microphone, and the earphone and the microphone are connected to each other by using signal lines or simple mechanisms. In this way, the earphone can be close to an ear and the microphone can be close to a mouth. However, such a design makes the microphone receive ambient noise at the same time; consequently, clarity of the user's sound is greatly affected. In addition, to reduce a volume of the headset, another traditional headset performs communication through bluetooth, and the earphone and the microphone are disposed in a same housing. However, the microphone is still designed at an end closest to the mouth, and because a distance between the microphone and the mouth is longer, a more expensive directional microphone is needed to receive the sound.

SUMMARY OF THE INVENTION

The present invention provides an in-ear microphone with active noise control, to solve a problem in the known art that a microphone has a poor sound receiving effect and high costs.

The in-ear microphone with active noise control of the present invention includes a housing, a speaker unit and a microphone module. The housing includes an air hole and a sound outlet. The speaker unit is disposed in the housing, and separates a space in the housing into a front chamber and a rear chamber. The microphone module is at least partially located in the front chamber and between the sound outlet and the speaker unit. The air hole is in communication with the sound outlet through the front chamber. The microphone module is configured to receive sound of a user and ambient sound.

In an embodiment of the present invention, the microphone module includes only a single composite microphone that is disposed in the front chamber.

In an embodiment of the present invention, the microphone module includes a call microphone and a first noise control microphone. The call microphone is disposed in the front chamber and located between the sound outlet and the speaker unit. The call microphone is configured to receive the sound of the user. The first noise control microphone is disposed at the housing and is configured to receive the ambient sound.

In an embodiment of the present invention, the first noise control microphone is disposed outside the housing.

In an embodiment of the present invention, the first noise control microphone is disposed in the front chamber.

In an embodiment of the present invention, the in-ear microphone with active noise control further includes a second noise control microphone that is disposed outside the housing and is configured to receive the ambient sound.

In an embodiment of the present invention, the in-ear microphone with active noise control further includes a high-pass filter circuit that is disposed in the housing and is electrically connected to the microphone module. A cut-off frequency of the high-pass filter circuit is greater than or equal to 300 Hz.

In an embodiment of the present invention, the in-ear microphone with active noise control further includes a high-pass filter circuit that is disposed in the housing and is electrically connected to the microphone module. A slope of the high-pass filter circuit is greater than or equal to 3 dB/octave.

In an embodiment of the present invention, the in-ear microphone with active noise control further includes a bluetooth communicating unit that is disposed in the housing and is electrically connected to the speaker unit and the microphone module. The bluetooth communicating unit includes a sound feedback suppression circuit.

In an embodiment of the present invention, the speaker unit separates the space in the housing into the front chamber and the rear chamber that are not in air communication with each other, and a contact part between the speaker unit and the housing is an air-tight contact.

In an embodiment of the present invention, the in-ear microphone with active noise control further includes an air-permeable moisture-proof element that is disposed in a sound receiving hole of the microphone module.

In an embodiment of the present invention, the in-ear microphone with active noise control further includes an air-permeable moisture-proof element that is disposed in the sound outlet.

In an embodiment of the present invention, the in-ear microphone with active noise control further includes an air-permeable moisture-proof element that is disposed in the air hole.

In an embodiment of the present invention, the in-ear microphone with active noise control further includes an ear pad that is disposed outside the sound outlet of the housing.

Based on the foregoing, in the in-ear microphone with active noise control of the present invention, not only an improved sound receiving effect can be provided, but also a function of active noise control is provided.

In order to make the aforementioned and other objectives and advantages of the present invention more comprehensible, the following uses exemplary embodiments for detailed descriptions with reference to the accompanying drawings.

DESCRIPTION OF THE EMBODIMENTS

Figure 1:
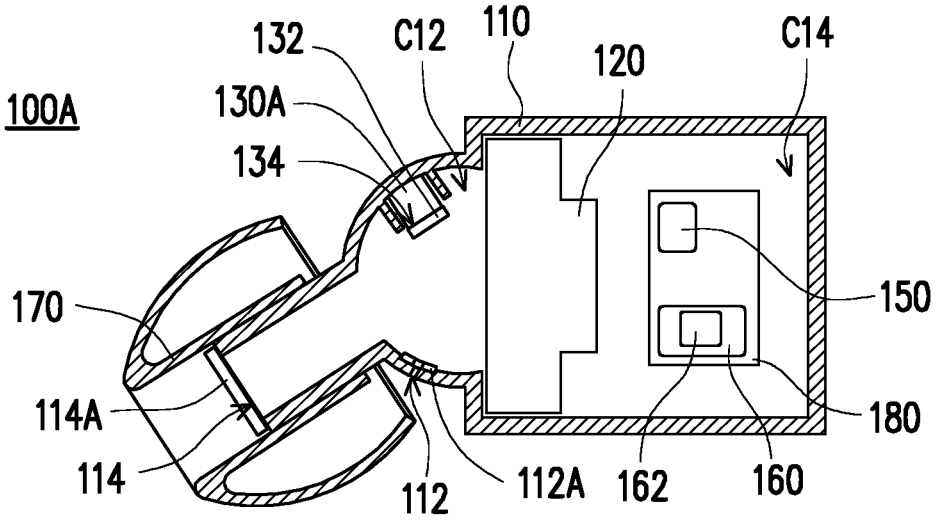
FIG. 1 is a schematic diagram of an in-ear microphone with active noise control according to an embodiment of the present invention.

FIG. 1 is a schematic diagram of an in-ear microphone with active noise control according to an embodiment of the present invention. Referring to FIG. 1, an in-ear microphone 100A with active noise control in this embodiment includes a housing 110, a speaker unit 120 and a microphone module 130A. The housing 110 includes an air hole 112 and a sound outlet 114. The speaker unit 120 is disposed in the housing 110, and separates a space in the housing 110 into a front chamber C12 and a rear chamber C14. The microphone module 130A is at least partially located in the front chamber C12 and between the sound outlet 114 and the speaker unit 120. The air hole 112 is in communication with the sound outlet 114 through the front chamber C12. In other words, the air hole 112 and the sound outlet 114 are respectively connected to the front chamber C12. When the in-ear microphone 100A with active noise control is worn on an ear of a user, sound played by the speaker unit 120 leaves the in-ear microphone 100A with active noise control from the sound outlet 114 through the front chamber C12, and reaches a tympanic membrane of the user.

The microphone module 130A is configured to receive sound of the user and ambient sound. In other words, the microphone module 130A is configured to provide a call function to transmit the received sound of the user to a call object. Meanwhile, the microphone module 130A is also configured to receive the ambient sound to meet a need that relevant information of instant ambient sound needs to be used during active noise control. In this embodiment, the microphone module 130A includes only a single composite microphone that is disposed in the front chamber. That is, the microphone module 130A includes only one microphone unit, but the microphone module 130A can be configured to receive the sound of the user and the ambient sound simultaneously. For example, the microphone module 130A converts, through the single composite microphone, vibrations generated when sound waves are received into electrical signals, then converts the analog electrical signals into digital signals to transmit to the call object to make a voice call, meanwhile the digital signals are phase-inverted and then added to signals used to drive the speaker unit 120 to implement active noise control.

In this embodiment, the sound outlet 114 faces and is close to the tympanic membrane of the ear of the user, and the microphone module 130A receives, at a location very close to the tympanic membrane of the user, the sound waves transmitted in an auditory canal. Because the microphone module 130A is very close to the tympanic membrane of the user, the sound waves generated by vibrations of the tympanic membrane when the user speaks can be sensitively detected and collected by the microphone module 130A, and bones of a human can also transmit the sound of the user well into the auditory canal to be collected by the microphone module 130A. In addition, the speaker unit 120 and the housing 110 can block most of the ambient sound and prevent most of the ambient sound from being transmitted to the microphone module 130A, to produce an effect of passive noise control and improve fidelity of the sound. In addition, when the in-ear microphone 100A with active noise control is worn on the ear of the user, space in the ear of the user can be in communication with the outside through the sound outlet 114, the front chamber C12 and the air hole 112, so that an occlusion effect that may occur can be improved. In addition, sound of a caller transmitted by the microphone module 130A to the other end will be clearer.

In this embodiment, the in-ear microphone 100A with active noise control can have a circuit for microphone signal compensation built inside, or electronic devices such as connected mobile phones and bluetooth communication devices provide software or a circuit for microphone signal compensation. In this way, a problem that the vibrations of the tympanic membrane may be amplified when less than or equal to 500 Hz and attenuated when greater than or equal to 2 KHz. Specifically, the in-ear microphone 100A with active noise control may include a high-pass filter circuit 150, a cut-off frequency of the high-pass filter circuit 150 is, for example, greater than or equal to 300 Hz, and a slope of the high-pass filter circuit 150 is, for example, greater than or equal to 3 dB/octave. The slope of the high-pass filter circuit 150 is that a power gain of the high-pass filter circuit 150 varies with a frequency, and a power gain variation of each octave is greater than or equal to 3 dB.

In this embodiment, the in-ear microphone 100A with active noise control may further include a bluetooth communicating unit 160 that is disposed in the housing 110 and is electrically connected to the speaker unit 120 and the microphone module 130A. The bluetooth communicating unit 160 includes a sound feedback suppression circuit 162. The electrical connection between the bluetooth communicating unit 160 and the speaker unit 120 and the microphone module 130A may be achieved through conducting wires and a circuit board 180. The conducting wires are omitted and not shown in FIG. 1. Through the bluetooth communicating unit 160, the in-ear microphone 100A with active noise control in this embodiment performs transmission and reception of sound signals with the electronic device through a method of bluetooth communication. Meanwhile, the bluetooth communicating unit 160 includes a sound feedback suppression circuit, so that voice signals sent by the microphone module 130A are only voice signals collected from a speaker unit end, that is, the sound of the user, and sound of a receiver end from the speaker unit 120 is not mixed. Certainly, the in-ear microphone 100A with active noise control of the present invention can perform transmission and reception of the sound signals with the electronic device in a wired manner, so that the electronic device can have a sound feedback suppression function described above. In addition, batteries can be disposed in the in-ear microphone 100A with active noise control of this embodiment, but the batteries are omitted and not shown in FIG. 1.

In this embodiment, the speaker unit 120 separates the space in the housing 110 into the front chamber C12 and the rear chamber C14 that are not in air communication, and a contact part between the speaker unit 120 and the housing 110 is an air-tight contact. Therefore, air cannot be transferred from the rear chamber C14 to the front chamber C12, thereby reducing a possibility that the ambient sound is collected by the microphone module 130A.

In this embodiment, the in-ear microphone 100A with active noise control may further optionally include air-permeable moisture-proof elements 132, 114A and 112A. The air-permeable moisture-proof element 132 is disposed in a sound receiving hole 134 of the microphone module 130A. The air-permeable moisture-proof element 114A is disposed in the sound outlet 114. The air-permeable moisture-proof element 112A is disposed in the air hole 112. The air-permeable moisture-proof elements 114A and 112A can also prevent foreign matters from entering the housing 110. The air-permeable moisture-proof elements 132, 114A and 112A may be waterproof air-permeable films, or moisture-proof treated meshes, or other appropriate air-permeable moisture-proof elements.

Because a part of the in-ear microphone 100A with active noise control is placed in the auditory canal and touches skin, the in-ear microphone 100A with active noise control is affected by a body temperature (36° C.), while an exposed part of the in-ear microphone 100A with active noise control is affected by an environment. Generally, when an environment temperature is close to 0° C., because of impact of a temperature difference, steam condensation easily occurs, and the microphone module 130A is severely affected. Consequently, sensitivity of the microphone module 130A is severely reduced, and it is particularly obvious when an electrostatic microphone is used. The problem can be improved by using the air-permeable moisture-proof element 132. In addition, the microphone module 130A of this embodiment may also be a capacitive microphone, a micro-electro-mechanical microphone or other forms of microphones.

In this embodiment, the in-ear microphone 100A with active noise control further includes an ear pad 170 that is disposed outside the sound outlet 114 of the housing 110. Specifically, a part of the housing 110 that is close to the sound outlet 114 may be tubular, and the ear pad 170 is sleeved outside the tubular part. The ear pad 170 can be elastically deformed appropriately based on a contour of the auditory canal of the user to fit the auditory canal and roughly isolate external sound. When the ear pad 170 is assembled, attention should be paid to avoid covering the air hole 112 to ensure that the air hole 112 can function properly.

The in-ear microphone 100A with active noise control of this embodiment can use a single-earpiece design or a double-earpiece design. When the double-earpiece design is used, the microphone module 130A may be disposed on one side, while a virtual microphone module may be disposed on the other side to make sound fields of the two sides consistent. An appearance of the virtual microphone module is the same as that of a real microphone module 130A, but the virtual microphone module does not have a sound receiving function.

Figure 2:
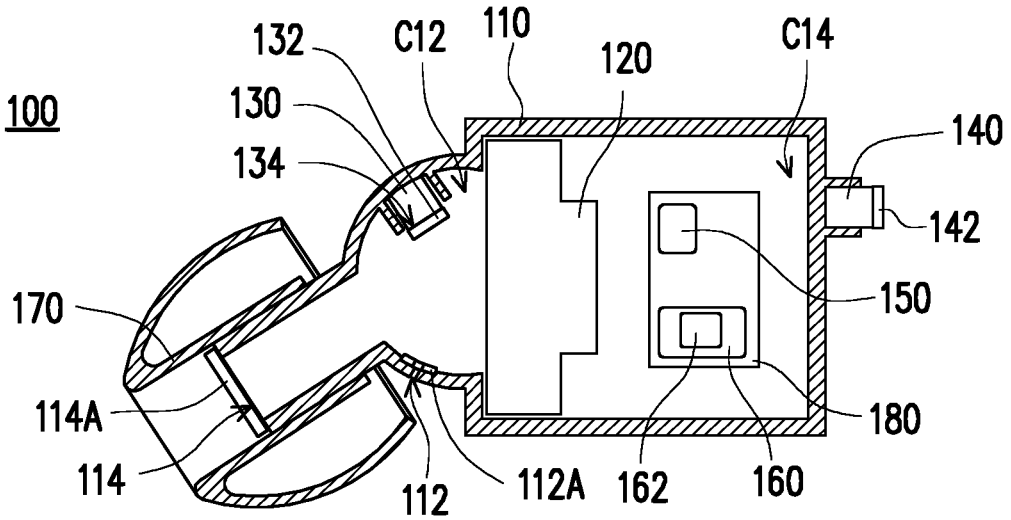
FIG. 2 is a schematic diagram of an in-ear microphone with active noise control according to another embodiment of the present invention.

FIG. 2 is a schematic diagram of an in-ear microphone with active noise control according to an embodiment of the present invention. An in-ear microphone 100 with active noise control of this embodiment is similar to the in-ear microphone 100A with active noise control in FIG. 1, and only differences of the two are described herein. Referring to FIG. 1, a microphone module of the in-ear microphone 100 with active noise control of this embodiment includes a call microphone 130 and a first noise control microphone 140, which is not like the microphone module 130A in FIG. 1 that includes only a single composite microphone. The call microphone 130 is disposed in the front chamber C12 and located between the sound outlet 114 and the speaker unit 120.

The call microphone 130 is configured to receive the sound of the user. The first noise control microphone 140 is disposed on the housing 110 and is configured to receive the ambient sound. In other words, the call microphone 130 is configured to provide the call function to transmit the received sound of the user to the call object. The first noise control microphone 140 is configured to receive the ambient sound to meet the need that the relevant information of the instant ambient sound needs to be used during active noise control. The call microphone 130 and the first noise control microphone 140 can use microphones of a same form, or microphones of different forms. This is not limited in the present invention. In this embodiment, the first noise control microphone 140 is disposed outside the housing 110, and has better design freedom without occupying limited space of the front chamber C12. This is not limited in the present invention. In the architecture, the in-ear microphone 100 with active noise control can provide feed-forward denoising.

In this embodiment, the bluetooth communicating unit 160 is electrically connected to the speaker unit 120 and the call microphone 130. The electrical connection between the bluetooth communicating unit 160 and the speaker unit 120 and the call microphone 130 may be achieved through the conducting wires and the circuit board 180. The conducting wires are omitted and not shown in FIG. 2. The bluetooth communicating unit 160 includes a sound feedback suppression circuit, so that voice signals sent by the call microphone 130 are only voice signals collected from the speaker unit end, that is, the sound of the user, and the sound of the receiver end made by the speaker unit 120 is not mixed.

In this embodiment, the speaker unit 120 separates the space in the housing 110 into the front chamber C12 and the rear chamber C14 that are not in air communication, and a contact part between the speaker unit 120 and the housing 110 is an air-tight contact. Therefore, air cannot be transferred from the rear chamber C14 to the front chamber C12, thereby reducing a possibility that the ambient sound is collected by the call microphone 130.

In this embodiment, the in-ear microphone 100A with active noise control may further optionally include air-permeable moisture-proof elements 132, 114A, 112A and 142. The air-permeable moisture-proof element 132 is disposed in a sound receiving hole 134 of the call microphone 130. The air-permeable moisture-proof element 114A is disposed in the sound outlet 114. The air-permeable moisture-proof element 112A is disposed in the air hole 112. The air-permeable moisture-proof element 142 is disposed in a sound receiving hole of the first noise control microphone 140. The air-permeable moisture-proof elements 114A and 112A can also prevent foreign matters from entering the housing 110. The air-permeable moisture-proof elements 132, 114A, 112A and 142 may be waterproof air-permeable films, or moisture-proof treated meshes, or other appropriate air-permeable moisture-proof elements.

Figure 3:
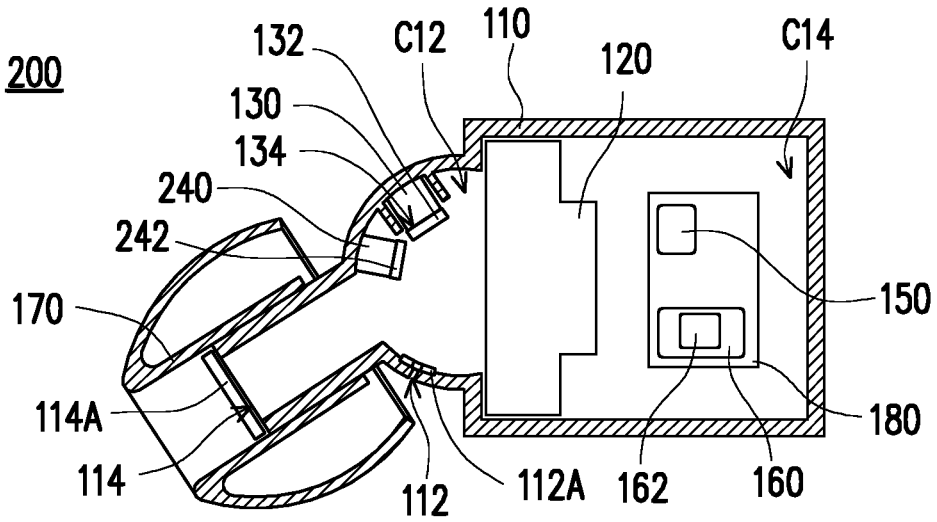
FIG. 3 is a schematic diagram of an in-ear microphone with active noise control according to still another embodiment of the present invention.

FIG. 3 is a schematic diagram of an in-ear microphone with active noise control according to still embodiment of the present invention. An in-ear microphone 200 with active noise control of this embodiment is similar to the in-ear microphone 100 with active noise control in FIG. 2, and only differences of the two are described herein. In this embodiment, a first noise control microphone 240 is disposed in the front chamber C12. In the architecture, the in-ear microphone 100 with active noise control can provide the feedbackward denoising. Because the first noise control microphone 240 is disposed in the front chamber C12 and is closer to the tympanic membrane, received ambient sound is closer to the ambient sound that the user actually heard, so that a noise control effect may be better. In addition, the in-ear microphone 200 with active noise control may optionally further include a moisture-proof element 242 disposed in a sound receiving hole of the first noise control microphone 240.

Figure 4:
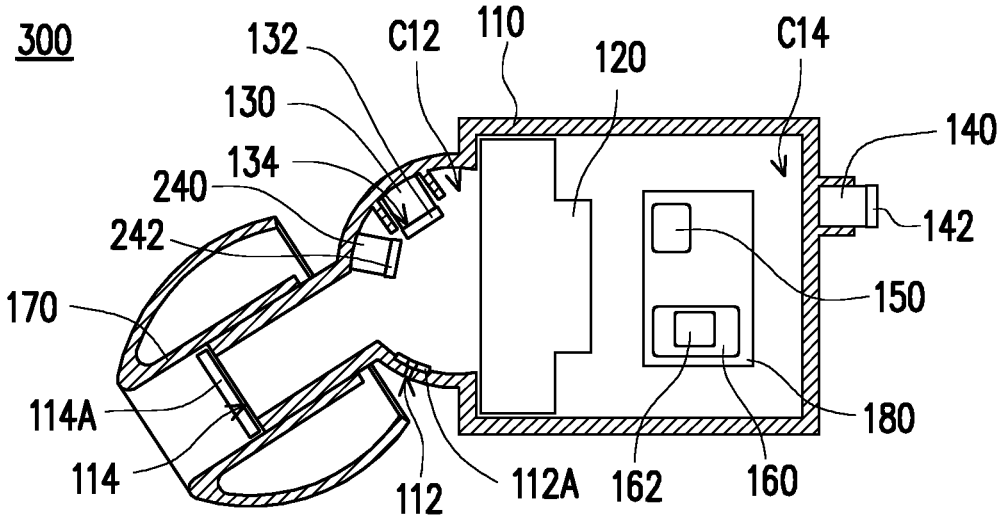
FIG. 4 is a schematic diagram of an in-ear microphone with active noise control according to yet another embodiment of the present invention.

FIG. 4 is a schematic diagram of an in-ear microphone with active noise control according to yet another embodiment of the present invention. An in-ear microphone 300 with active noise control of this embodiment is similar to the in-ear microphone 100 with active noise control in FIG. 2, and only differences of the two are described herein. In this embodiment, in addition to the first noise control microphone 140 in FIG. 2, a noise control microphone 240 the same as that in FIG. 3 is further included, respectively disposed outside the housing 110 and the front chamber C12. In the architecture, the in-ear microphone 300 with active noise control can provide hybrid denoising.

Based on the foregoing, in the in-ear microphone with active noise control of the present invention, the call microphone is located between the sound outlet and the speaker unit and is directly close to the tympanic membrane of the user, and the housing includes the air hole that can improve the sound receiving effect. In addition, a configuration of the first noise control microphone also provides the function of active noise control.

Although the present invention is disclosed in the embodiments above, it is not intended to limit the present invention. It will be apparent to those skilled in the art that various modifications and variations can be made to the structure of the present invention without departing from the scope or spirit of the present invention. In view of the foregoing, it is intended that the present invention cover modifications and variations of the present invention provided they fall within the scope of the following claims and their equivalents.

What is claimed is:

1. An in-ear microphone with active noise control, comprising:

a housing having an air hole and a sound outlet;

a speaker unit disposed in the housing and separating a space in the housing into a front chamber and a rear chamber, wherein the rear chamber is a closed space without being in communication with outside; and a microphone module at least partially located in the front chamber and between the sound outlet and the speaker unit, wherein the air hole is in communication with the sound outlet through the front chamber, and the microphone module is configured to receive sound of a user and ambient sound, wherein the air hole is not disposed on an extension surface of a sound output surface of the speaker unit, wherein the microphone module comprises:

a call microphone disposed in the front chamber and located between the sound outlet and the speaker unit, wherein the call microphone is configured to receive the sound of the user; and a first noise control microphone disposed at the housing and configured to receive the ambient sound.

2. The in-ear microphone with active noise control according to claim 1, wherein the microphone module comprises only a single composite microphone that is disposed in the front chamber.

3. The in-ear microphone with active noise control according to claim 1, wherein the first noise control microphone is disposed outside the housing.

4. The in-ear microphone with active noise control according to claim 1, wherein the first noise control microphone is disposed in the front chamber.

5. The in-ear microphone with active noise control according to claim 4, further comprising a second noise control microphone disposed outside the housing and configured to receive the ambient sound.

6. The in-ear microphone with active noise control according to claim 1, further comprising a high-pass filter circuit disposed in the housing and electrically connected to the microphone module, wherein a cut-off frequency of the high-pass filter circuit is greater than or equal to 300 Hz.

7. The in-ear microphone with active noise control according to claim 1, further comprising a high-pass filter circuit disposed in the housing and electrically connected to the microphone module, wherein a slope of the high-pass filter circuit is greater than or equal to 3 dB/octave.

8. The in-ear microphone with active noise control according to claim 1, further comprising a bluetooth communicating unit disposed in the housing and is electrically connected to the speaker unit and the microphone module, wherein the bluetooth communicating unit comprises a sound feedback suppression circuit.

9. The in-ear microphone with active noise control according to claim 1, wherein the speaker unit separates the space in the housing into the front chamber and the rear chamber that are not in air communication with each other, and a contact part between the speaker unit and the housing is an air-tight contact.

10. The in-ear microphone with active noise control according to claim 1, further comprising an air-permeable moisture-proof element disposed in a sound receiving hole of the microphone module.

11. The in-ear microphone with active noise control according to claim 1, further comprising an air-permeable moisture-proof element disposed in the sound outlet.

12. The in-ear microphone with active noise control according to claim 1, further comprising an air-permeable moisture-proof element disposed in the air hole.

13. The in-ear microphone with active noise control according to claim 1, further comprising an ear pad disposed outside the sound outlet of the housing.

* * * * *